United States Patent [19]

Good

[11] Patent Number: 4,863,128

[45] Date of Patent: Sep. 5, 1989

[54] LINER REINFORCED HANG TAB

[75] Inventor: David M. Good, Peachtree City, Ga.

[73] Assignee: Voxcom, Inc., Peachtree City, Ga.

[21] Appl. No.: 193,767

[22] Filed: May 13, 1988

[51] Int. Cl.[4] ..... A47G 29/00

[52] U.S. Cl. ..... 248/205.3; 156/267; 428/41

[58] Field of Search ..... 248/205.3, 205.4, 214, 248/359 A, 359 G, 359 H, 359 I, 360; 156/267, 268; 428/41, 42, 136, 194; 40/661, 642

[56] References Cited

U.S. PATENT DOCUMENTS

| | | | |
|---|---|---|---|
| 2,679,928 | 6/1954 | Bishop | 156/268 |
| 2,725,322 | 11/1955 | Muttera | 428/41 |
| 2,896,351 | 7/1959 | Johnson | 428/41 |
| 2,940,884 | 6/1960 | White | 428/41 |
| 3,508,754 | 4/1970 | Shorin | 428/42 |
| 3,884,443 | 5/1975 | McMaster | 428/194 |
| 4,122,857 | 10/1978 | Haerr | 248/205.3 |
| 4,153,496 | 5/1979 | Swift | 156/267 |
| 4,446,183 | 5/1984 | Savagian | 428/42 |
| 4,624,875 | 11/1986 | Watanabe | 428/41 |
| 4,680,210 | 7/1987 | Corcoran | 428/42 |

FOREIGN PATENT DOCUMENTS

| | | | |
|---|---|---|---|
| 1369085 | 6/1964 | France | 428/42 |
| 2050035 | 8/1971 | France | 428/42 |
| 151877 | 10/1955 | Sweden | 428/41 |
| 1175296 | 12/1969 | United Kingdom | 248/359 G |

*Primary Examiner*—Ramon O. Ramirez
*Assistant Examiner*—Robert A. Olson
*Attorney, Agent, or Firm*—Stonebraker, Shepard & Stephens

[57] ABSTRACT

Hanging regions (22) of hang tags (25) are reinforced by a permanently bonded portion of a liner strip (11), an uncut portion of which releasably carries a row of die cut hang tabs. Liner strip (11) has a release coating on edge regions (16) where stick-on regions (23) of die cut hang tabs are releasably carried. The reinforced head regions (22) of the hang tabs are die cut through both the tab strip (12) and liner strip (11), and the stick-on regions of the tab strips are die cut only through the tab strip so that uncut liner edge regions (16) releasably carry a row of hang tabs.

23 Claims, 3 Drawing Sheets

LINER REINFORCED HANG TAB

BACKGROUND

Hang tabs for supporting packages on hanging wires of retail display racks can be made of thick and tough resin material that does not require any reinforcing. Such a resin strip is expensive, however, and needs a formed hinge line to be flexible enough to fold flat against a package, for shipping.

Hang tabs can also be made of a thinner and less expensive resin strip, but this requires a reinforcing layer in the hanging region of the tab. Such reinforcing has been done by adhering a reinforcing band to the reinforced region of the tab strip, before the tabs are die cut. This requires, besides the reinforcing band, an adhesive layer on the reinforcing band and a wasted liner strip covering that adhesive layer.

I have discovered a way of using a portion of the liner for a hang tab strip for reinforcing the hanging region of the tabs, while the remainder of the liner releasably carries the tabs. Since the liner is otherwise wasted, using a portion of it to reinforce the hanging region of the tabs economizes on material and makes my liner reinforced hang tabs cost effective. Although my invention requires a specially prepared supply web, liner reinforced hang tabs can be die cut from this at high speed to form reliably reinforced hang tabs releasably carried on a portion of the liner strip.

SUMMARY OF THE INVENTION

My liner reinforced hang tabs have a tab strip releasably adhered to a liner strip in a stick-on region of the hang tab and permanently adhered to the liner strip in a hanging region of the hang tab. The tab strip and liner strip are both die cut around a periphery of the hang tab in the hanging region; and only the tab strip is die cut around a periphery of the hang tab in the stick-on region, where the uncut liner strip releasably carries the hang tabs. I accomplish this by zone coating a liner strip with a release coating in the stick-on region and no release coating in the reinforcing region, and I prefer that the tab strip not be adhered to the liner strip in a longitudinal hinge region between the stick-on region and the reinforcing region. The hang tabs are die cut from both the tab strip and the reinforcing portion of the liner strip so that the hanging region of each tab includes both the tab strip and the permanently adhered liner strip, and a stick-on region of each tab is releasably carried on an uncut portion of the liner strip.

DRAWINGS

DETAILED DESCRIPTION

Figure 1:
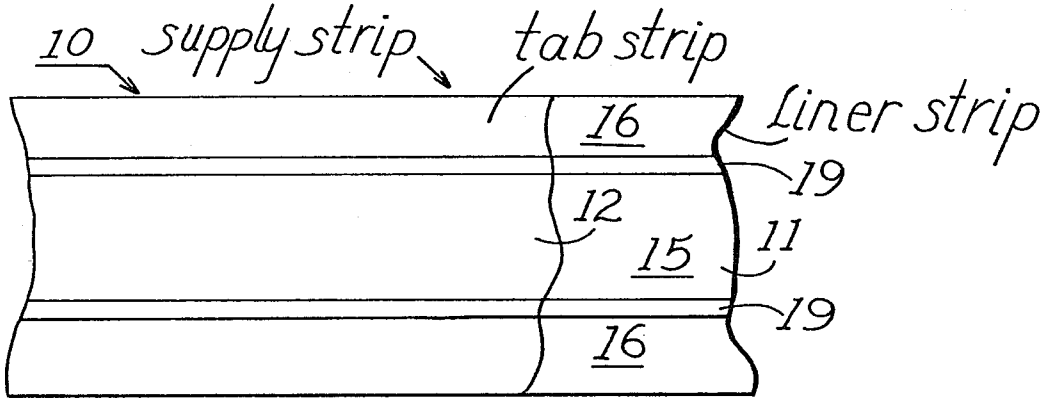
FIG. 1 is a partially cut-away, plan view of a supply strip prepared for making liner reinforced hang tabs according to my invention.
Figure 2:
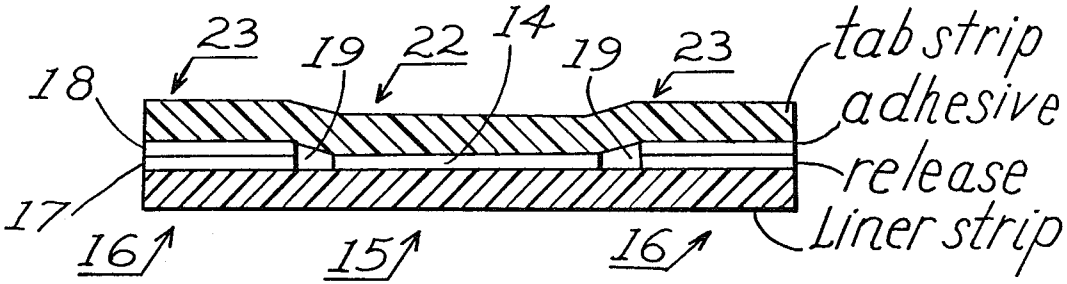
FIG. 2 is a cross-sectional view of the supply strip of FIG. 1.

To make liner reinforced hang tabs according to my invention, I first divide a liner strip into a reinforcing region, where the liner strip is permanently adhered to a tab strip, and a stick-on region, where the liner strip is releasably adhered to a tab strip. Such a division is shown in FIGS. 1 and 2 for supply strip 10 having a liner 11 and a tab strip 12. A central reinforcing region 15 of liner strip 11 is coated with a permanent adhesive 14 having no release coating, so that tab strip 12 permanently bonds to liner strip 11 in reinforcing region 15. Opposite edge regions 16 of liner strip 11 are coated with a release 17 and an adhesive 18 so that stick-on regions 23 of tab strip 12 are releasably adhered to liner strip 11. In between central reinforcing region 15 and stick-on edge regions 16 are longitudinal hinge bands 19 where tab strip 12 is not adhered to liner strip 11. Hinge bands 19 form the hinges of hang tabs 25, when these are die cut from supply strip 10, as shown in FIGS. 3 and 4.

Figure 3:
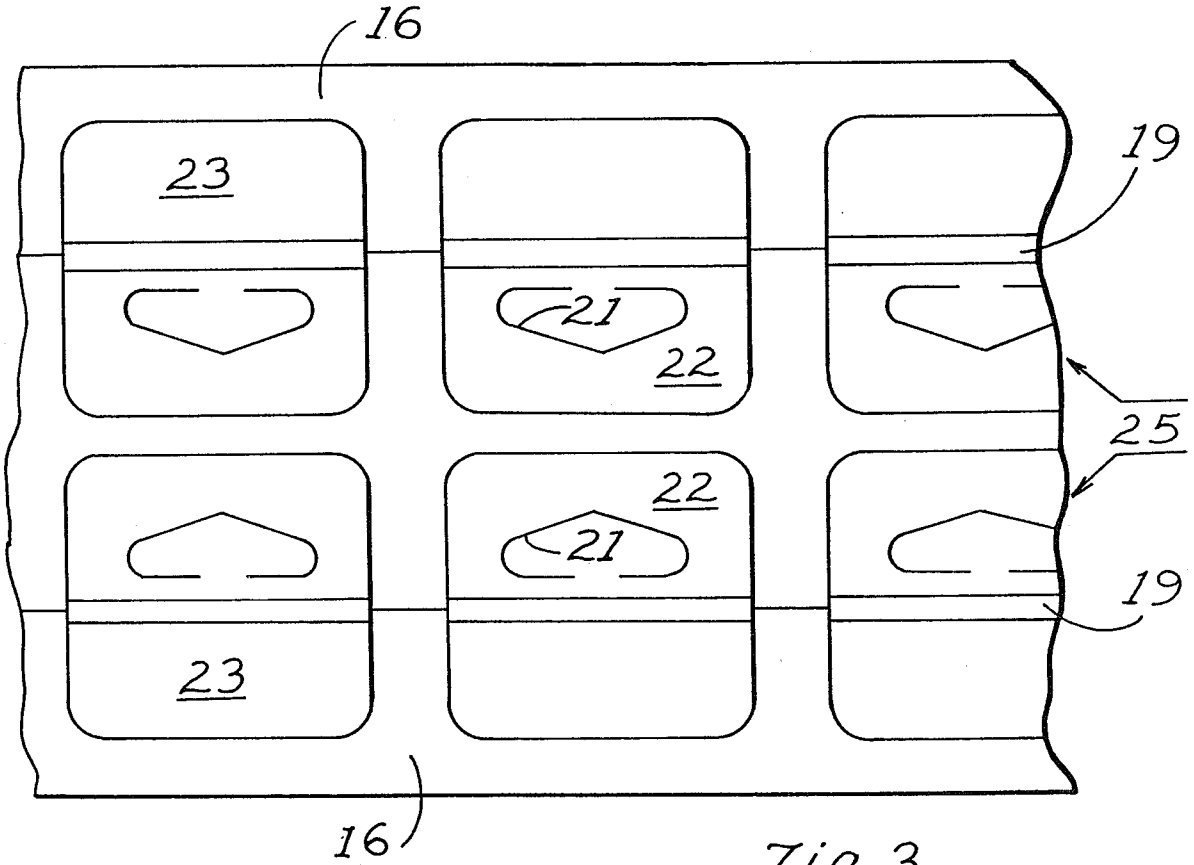
FIG. 3 is a plan view of the supply strip of FIG. 1 die cut into hang tabs that are liner reinforced, according to my invention.
Figure 4:
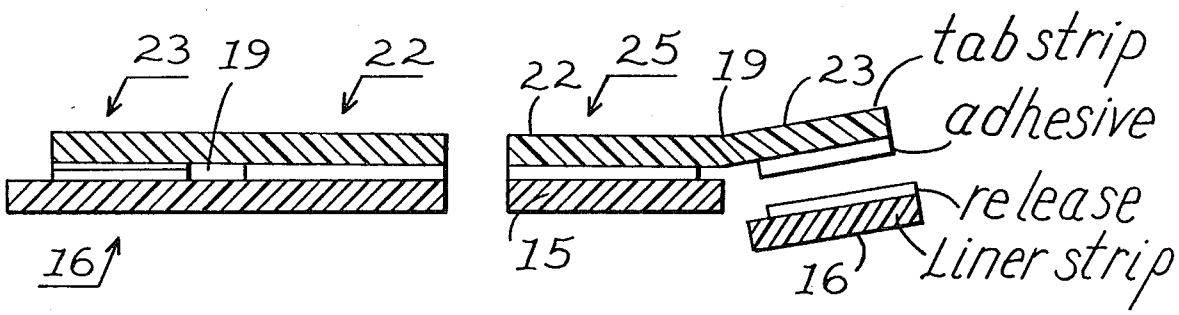
FIG. 4 is a cross-sectional view of the hang tab strips of FIG. 3, showing one hang tab released from its liner strip.

Reinforcing region 15 is preferably arranged along the longitudinal central region of supply strip 10 so that two rows of hang tabs 25, oriented head to head, as shown in FIG. 3, can be die cut from strip 10. A supply strip can also be prepared with a single stick-on region and a single reinforcing region for making a single row of hang tabs 25. The die cutting and the removal of waste material around each tab 25 divides supply strip 10 into two separate rows of hang tabs 25 each having a stick-on region 23 releasably carried by an uncut edge portion 16 of liner 11. The die cutting extends through both tab strip 12 and liner 11 around the periphery of the head or reinforced hanging region 22 of each hang tab 25. The die cutting extends only through tab strip 12 around the periphery of stick-on region 23 of each tab 25, leaving edge regions 16 of liner strip 11 uncut, for releasably supporting the stick-on regions 23 of tabs 25.

Besides the peripheral cuts around each tab 25, each hanging region 22 has a die cut 21 that can open through both strips 11 and 12 to receive a hanging wire. Head regions 22 of each row of hang tabs 25 have the same thickness as stick-on regions 23 carried on liner strip portions 16 so that a roll of supply tabs 25 is wound equally tight along its opposite edges. This makes a firm and easy-to-handle roll that is not likely to telescope.

Tab strip 12 is preferably formed of clear resin material so that it can be adhered to an object or package without concealing anything. Liner strip 11 can also be formed of clear resin, as I prefer, or can be formed of paper. Since the liner is used to draw a row of tabs 25 into machinery that applies the tabs to objects or packages, it is important that liner 11 have adequate tensile strength; and this is a reason for preferring resin over paper. If paper is used, it can be preprinted with a logo, brand name, or other information that becomes visible in the reinforced head region 22, to add to the display.

Since the reinforcing of the hanging regions 22 of tabs 25 is accomplished with a portion of liner strip 11, and since only edge regions 16 of liner 11 are wasted, my way of reinforcing hang tabs with a portion of liner 11 economizes on liner material. Although supply strip 10 requires the extra expense of zone coating stick-on regions 16 and reinforcing region 15, this is offset by the saving in liner material. Also supply strip 10 can run at high speed through a die that cuts out hang tabs 25, and this helps keep manufacturing costs low. The goal achieved by my invention is a lower cost hang tab that is reinforced and adequately strong in its hanging region.

I claim:

1. A liner reinforced hang tab having a hanging region and a stick-on region and comprising:

a. a liner strip;

b. a clear resin tab strip;

c. said tab strip being releasably adhered to said liner strip in said stick-on region of said hang tab;

d. said tab strip being permanently adhered to said liner strip in said hanging region of said hang tab;

e. said tab strip and said liner strip both being die cut around a periphery of said hang tab in said hanging region where said liner strip reinforces said tab strip; and f. only said tab strip being die cut around a periphery of said hang tab in said stick-on region, where said liner strip releasably carries said hang tab.

2. The hang tab of claim 1 wherein said tab strip is flexible in a hinge region of said hang tab, between said stick-on region and said hanging region.

3. The hang tab of claim 2 wherein said tab strip is not adhered to said liner strip in said hinge region.

4. The hang tab of claim 1 wherein said liner strip is formed of clear resin.

5. The hang tab of claim 4 wherein said tab strip is flexible in a hinge region of said hang tab, between said stick-on region and said hanging region.

6. The hang tab of claim 5 wherein said tab strip is not adhered to said liner strip in said hinge region.

7. A supply laminate for forming liner reinforced hang tabs, said supply laminate comprising:

a. a liner strip and a clear resin tab strip partially adhered together;

b. a continuous longitudinal stick-on region extending for the length of said liner strip and having a release coating allowing an adhesive coated stick-on surface of said tab strip to release from said liner strip along said stick-on region;

c. a continuous longitudinal reinforced band extending for the length of said liner strip and spaced from and parallel with said stick-on region, said reinforced band being adhered to said tab strip without any release coating, for permanently bonding said liner strip to said tab strip along said reinforced band; and d. a continuous narrow hinge region extending for the length of said liner strip between said stick-on region and said reinforced band, said hinge region being free of adhesive so that said liner strip is not adhered to said tab strip in said hinge region.

8. The supply laminate of claim 7 wherein said liner strip and said tab strip are equal in width.

9. The supply laminate of claim 7 wherein said liner srip is formed of clear resin.

10. The supply laminate of claim 7 made wide enough for die cutting opposed pairs of hang tabs, arranged head to head, said permanent bonding of said tab strip and said liner strip in said reinforced band occurring in a central region of said supply laminate spanning opposed head regions of said hang tabs, said releasable bonding of said tab strip and said liner strip in said stick-on region occurring along opposite edge regions of said supply laminate, and said adhesive-free hinge region extending along opposite sides of said central region, between said central region and said opposite edge regions.

11. The supply laminate of claim 10 wherein said liner strip and said tab strip are equal in width.

12. The supply laminate of claim 10 wherein said liner strip is formed of clear resin.

13. A supply strip of hang tabs die cut from a tab strip and carried by a liner strip, said supply strip comprising:

a. said liner strip being die cut, with said tab strip, around a hanging region of each of said hang tags;

b. die cut portions of said liner strip being permanently adhered to said tab strip in said hanging regions of said tabs, where said liner strip reinforces said tab strip; and c. an uncut portion of said liner strip being releasably adhered to said tab strip in stickon regions of said tabs die cut from said tab strip and carried on said uncut portion of said liner strip.

14. The supply strip of claim 13 wherein hinge regions of each of said tabs extend along a longitudinal hinge band between said stick-on region and said hanging region.

15. The supply strip of claim 14 wherein said tabs are not adhered to said liner strip in said hinge band.

16. The supply strip of claim 13 being equally thick in said hanging region and in said stick-on region.

17. The supply strip of claim 13 wherein said liner strip is formed of clear resin.

18. A method of making liner reinforced hang tabs, said method comprising:

a. adhering a tab strip to a liner strip permanently in a longitudinal reinforcing region and releasably in a longitudinal stick-on region; and b. die cutting hang tabs from said tab strip and said liner strip so that: head regions of said tabs, in said reinforcing region, are die cut from both said tab strip and said liner strip permanently bonded to and reinforcing said tab strip; and stick-on regions of said tabs are die cut from said tab strip and are releasably carried on an uncut portion of said liner strip.

19. The method of claim 18 including not adhering said tab strip to said liner strip in a longitudinal hinge region between said reinforcing region and said stick-on region.

20. The method of claim 18 including making said liner strip of clear resin material.

21. The method of claim 18 including arranging said reinforcing region in central regions of said tab strip and said liner strip, arranging said stick-on region along opposite edge regions of said tab strip and said liner strip, and die cutting said hang tabs in two rows, arranged head to head.

22. The method of claim 21 including making said tab strip the same width of said liner strip.

23. The method of claim 22 including making said liner strip of clear resin material.

* * * * *